US009856585B1

(12) United States Patent
Sejiny

(10) Patent No.: US 9,856,585 B1
(45) Date of Patent: Jan. 2, 2018

(54) CIRCULAR LOOM OF MANNEQUIN

(71) Applicant: Umm Al-Qura University, Makkah (SA)

(72) Inventor: Rabah Sejiny, Makkah (SA)

(73) Assignee: Umm-Al-Qura University, Makkah (SA)

( * ) Notice: Subject to any disclaimer, the term of this patent is extended or adjusted under 35 U.S.C. 154(b) by 0 days.

(21) Appl. No.: 15/269,547

(22) Filed: Sep. 19, 2016

(51) Int. Cl.
*D03D 1/00* (2006.01)
*D03D 37/00* (2006.01)
*D03D 25/00* (2006.01)

(52) U.S. Cl.
CPC ..... *D03D 37/00* (2013.01)

(58) Field of Classification Search
CPC . A41H 3/007; A41H 3/00; A41H 3/04; A41H 1/00; A41H 43/04; A41H 5/01; D04B 37/00; D04B 1/24; G06T 17/00; G06T 2210/16; A41D 19/0082; A41D 19/0058
See application file for complete search history.

(56) References Cited

U.S. PATENT DOCUMENTS 2,039,157 A * 4/1936 Fleischer ..... D03J 1/16 28/186
2,456,513 A * 12/1948 Johnson ..... B29C 33/485 264/314
2,722,349 A * 11/1955 Katzman ..... A47F 8/02 223/74
2,985,502 A * 5/1961 Kronsbein ..... D06B 5/24 223/76
3,653,562 A * 4/1972 Kronsbein ..... D06B 5/24 223/76
4,106,313 A * 8/1978 Boe ..... D01F 8/10 66/178 A
4,550,579 A * 11/1985 Clifford ..... D06B 3/30 68/205 R
5,196,240 A * 3/1993 Stockwell ..... A41D 13/0005 2/82
5,244,131 A * 9/1993 Hollingsworth ..... A47F 8/00 223/85
5,419,268 A * 5/1995 Fyler ..... D05B 23/00 112/470.14
5,419,729 A * 5/1995 Gross ..... A63H 3/06 446/183
5,680,528 A * 10/1997 Korszun ..... A41H 3/007 345/630
5,913,708 A * 6/1999 Gross ..... A63H 3/06 446/183
6,662,980 B1 * 12/2003 Hickle ..... D06F 73/00 223/57

(Continued)

OTHER PUBLICATIONS

Wheel. Dictionary.com. Dictionary.com Unabridged. Random House, Inc. http://www.dictionary.com/browse/wheel (accessed: Sep. 11, 2017).*

*Primary Examiner* — Bobby Muromoto, Jr.
(74) *Attorney, Agent, or Firm* — Geeta Kadambi; Riddhi IP LLC

(57) ABSTRACT

A rotatable loom with a mannequin such that the loom can be used to produce a hand-made single piece of cloth or cloth product in a three dimension with a thread of choice. The loom has two or more frames with graded rings such that the rings help in achieving a cylindrical or cubic shape cloth.

14 Claims, 7 Drawing Sheets

(56) References Cited

U.S. PATENT DOCUMENTS 6,810,300 B1 * 10/2004 Woltman ..... G06F 17/5018 700/132
6,907,310 B2 * 6/2005 Gardner ..... A41H 1/00 700/132
6,968,297 B1 * 11/2005 Ziakovic ..... A41H 3/007 345/419
6,978,549 B2 * 12/2005 Ellis ..... A41H 1/00 33/1 C
7,033,403 B2 * 4/2006 Bentham ..... D06P 1/0016 8/499
7,663,648 B1 * 2/2010 Saldanha ..... G06T 17/00 345/419
7,788,754 B2 * 9/2010 Piana ..... D06B 1/02 68/205 R
7,862,045 B2 * 1/2011 Hodge ..... B63G 13/00 273/371
8,295,970 B2 * 10/2012 Piana ..... D06B 1/02 700/130
8,364,561 B2 * 1/2013 Wolper ..... G06T 17/00 700/132
9,304,018 B2 * 4/2016 Davis ..... G01D 5/3538
9,453,266 B2 * 9/2016 Amirova ..... C14B 1/00
9,681,694 B2 * 6/2017 Ng ..... A41H 3/04
2005/0164598 A1 * 7/2005 Kelsey ..... A63H 3/52 446/296
2006/0015207 A1 * 1/2006 Weiser ..... G06Q 10/06 700/132
2006/0265816 A1 * 11/2006 Abbott ..... D06B 19/0029 8/401
2007/0021940 A1 * 1/2007 Peter ..... A61B 5/107 702/155
2009/0126822 A1 * 5/2009 Kojima ..... D03D 29/00 139/29
2009/0291781 A1 * 11/2009 Caruso ..... A63B 69/002 473/444
2013/0238285 A1 * 9/2013 Volchek ..... A41H 5/01 702/188
2014/0006386 A1 * 1/2014 Oh ..... G06F 17/30115 707/722
2014/0129485 A1 * 5/2014 Fisher ..... A47F 7/0035 705/500
2014/0270906 A1 * 9/2014 Jackson ..... A63H 9/00 403/34
2015/0124266 A1 * 5/2015 Davis ..... G01D 5/3538 356/601
2016/0041581 A1 * 2/2016 Piccionelli ..... G06F 1/163 345/156
2016/0074902 A1 * 3/2016 Miller ..... B05B 1/00 427/212
2016/0101338 A1 * 4/2016 Daniels ..... A63B 69/34 482/8
2016/0106160 A1 * 4/2016 Carneiro ..... D05B 1/06 2/227
2016/0187166 A1 * 6/2016 Ranky ..... H01L 41/314 602/27
2016/0271841 A1 * 9/2016 Cristol-Donovan .... B29C 41/14
2016/0309822 A1 * 10/2016 Ng ..... A41H 3/04
2016/0309823 A1 * 10/2016 Ng ..... D04B 37/00
2017/0039775 A1 * 2/2017 Applegate ..... G06T 19/00
2017/0049170 A1 * 2/2017 Bacino ..... A41D 31/02
2017/0202277 A1 * 7/2017 Oku ..... A41D 13/012

* cited by examiner

CIRCULAR LOOM OF MANNEQUIN

FIELD OF TECHNOLOGY

This disclosure relates generally to a loom for a mannequin. More specifically, the disclosure relates to a circular and rotatable loom for a mannequin.

BACKGROUND

A mannequin is a roughly used by all the dress designers or other artists and people working in the garment industry. Mannequins helps in the display of clothes or other accessories within the garment industry and help customers and designers to picture the product. However, mannequin is largely a fixed object giving a limited usability.

SUMMARY

The present disclosure relates to a loom for a mannequin, wherein the loom is a circular loom. Further, the disclosure relates to a use of the loom in producing a single piece hand-made cloth using the loom and mannequin on the loom.

In one embodiment, the mannequin resembles an artificial body which embodies a natural human body. In another embodiment, the mannequin gives a three-dimensional illustration of the human body and thus can be used to envision a cloth product.

In one embodiment, the mannequin is put on a loom such that the loom holds the mannequin in an upright position. In another embodiment, the loop is a circular and rotatable loom.

In one embodiment, the loom comprise of more than one circular frame such as two circular frames. In another embodiment, the loom comprises of a first frame and a second frame. The first frame is the bottom most frame of the loom and is an animated frame. The first frame also holds a column in the middle of the bottom frame such that the mannequin can slide up and down the column. The column has slides such that the artificial body can be adjusted to an appropriate and required height. The column further comprise of a slider hole through the length of the column or at a particular location on the column such as the center position. The mannequin comprise of a hook such that the hook get fixed into the slider hole of the column so as to fix a position of the mannequin or the change the position of the mannequin as required by the user.

In one embodiment, the first frame further comprise of a wheel such that the wheel facilitate movement of the loom. In another embodiment, the first frame comprise of more than one wheel such that the wheel are rotatable up to 360 and helps in the movement of the loom with or without the mannequin from one location to another location. The wheels are present are on the side of the first frame facing the ground.

In one embodiment, the second frame is the higher or upper frame of the loom. In another embodiment, the second frame shares the same axis with the first frame. Thus, the first frame and the second frame are one over another. The column running from a center of the first frame passes from a center of the second frame. The second frame and first frame are connected to each other through one or more legs. The legs are of same height present in between the first frame and the second frame.

In one embodiment, the second frame further comprise of more than one ring whereas in another embodiment, the second frame comprise of two rings or three rings on the surface of the second frame The rings as present on the second frame facing towards the roof are of different diameters and placed one next to another. The rings are thus graded rings. Thus, there are three rungs such as an inside ring, a middle ring and an outside rings are present on the second frame of the loom. The inside ring may have a diameter ranging from 40-80 cm, the middle ring may have a diameter ranging from 60-100 cm and the outside ring may have a diameter ranging from 80-120 cm. The graded ring may have a diameter as required by the artist and in relation to the diameter of the second frame of the loom. The rings may be made of metal or other suitable material. The rings are easily removable or fixed onto the second frame of the loom. The rings help to flatten a warp yarn.

In one embodiment, the loom is used to produce a hand-made single piece of cloth wherein the cloth is made by using a threaded material. In another embodiment, the loom is used to produce a cylindrical or a conical shaped single piece of cloth using a threaded material wherein the thread material is used by letting it go down the mannequin onto the second frame and specifically onto the graded rings of the second frame where they are further weaved to form a particular dress or cloth product.

The column of the loom as disclosed is fixed on the first frame through a base such that the base is fixed or placed onto the first frame and the column runs through the center axis of the first frame and the second frame. The base is made of a material as available in the market.

Thus, in one embodiment, the present disclosure relates to a rotatable loom with a column wherein a mannequin can be placed onto the column and the height of the mannequin can be adjusted. In another embodiment, the present disclosure relates to a rotatable loom to produce a single piece of cloth by a threaded material by using the rotatable loom with graded rings.

In one method, a method of using a rotatable loom for a mannequin is disclosed. In another embodiment, the method comprises: preparing an artificial body, such as a mannequin of a particular measurement and shape; inserting a twine thread on the mannequin such that it helps in determining a shape of a front cut out of the front and back as well as a waist and a tail line for a production of a cloth; letting the mannequin down from the line underneath with a consideration of a number of threads in the centimeter range; letting the thread down from the mannequin following determination of the shape of the cut out from front and back of the mannequin along with the waist and tail line; pulling the thread onto the perimeter of a largest size to a smallest ring present on a frame of the loom such that a network of thread is achieved according to a shape of the frame; pulling the thread from all the sides of the mannequin onto the frame to form a complete piece of a cloth such that the cloth has a shape and size of according to the mannequin.

Other features will be apparent from the accompanying drawings and from the detailed description that follows.

BRIEF DESCRIPTION OF DRAWINGS

Example embodiments are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

The present disclosure relates to a rotatable loom such that the loom with a mannequin can be used to produce a hand-made single piece of cloth or cloth product.

Figure 1:
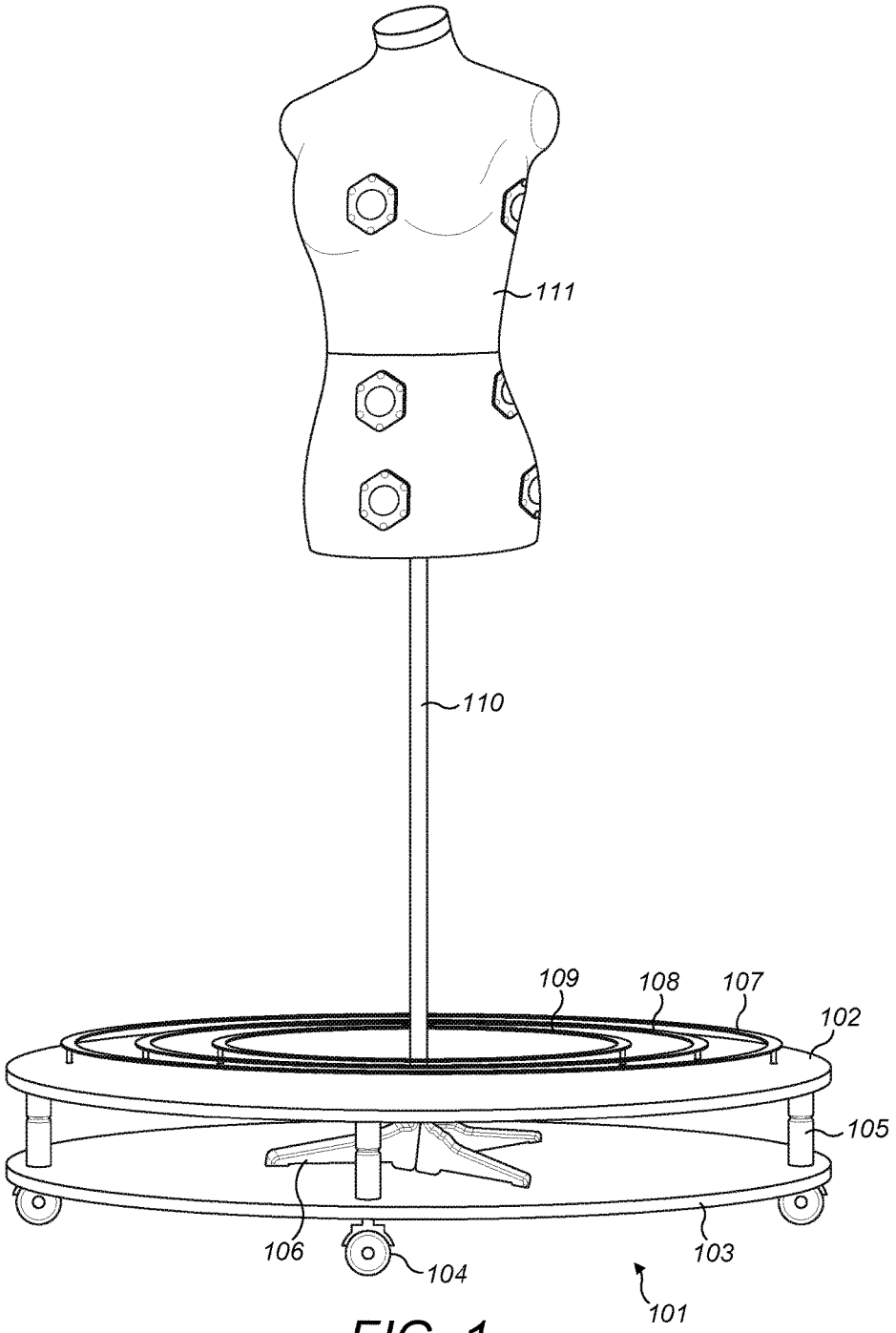
FIG. 1 shows a mannequin on a loom in a three dimensional view.

FIG. 1 shows the disclosed loom with the mannequin 101. The loom comprise of two frames such as a first frame 103 and a second frame 102. The first frame and the second frame are connected to each other through a leg 105 or more than one legs. The legs may be wooden or of such material as that of the frames. The height of the leg is 15 cm but can be more or less than 15 cm depending on the user requirement and manufacturer. The loom further comprises of more than one wheel 104 such as two wheels, three wheels or four wheels. The wheels are present on the side of the first frame facing the ground. The wheels can rotate 360 and thus helps in smooth moving of the loom with or without the mannequin from one location to another location. The loom further comprise of a column 110 such that the column runs through the center of the two frames up to its length. The column is connected to a base 106 present on or fixed to the first frame 103. A mannequin 111 can be placed onto the column 110 to be used for producing a single hand-made piece of cloth or cloth product.

Figure 3:
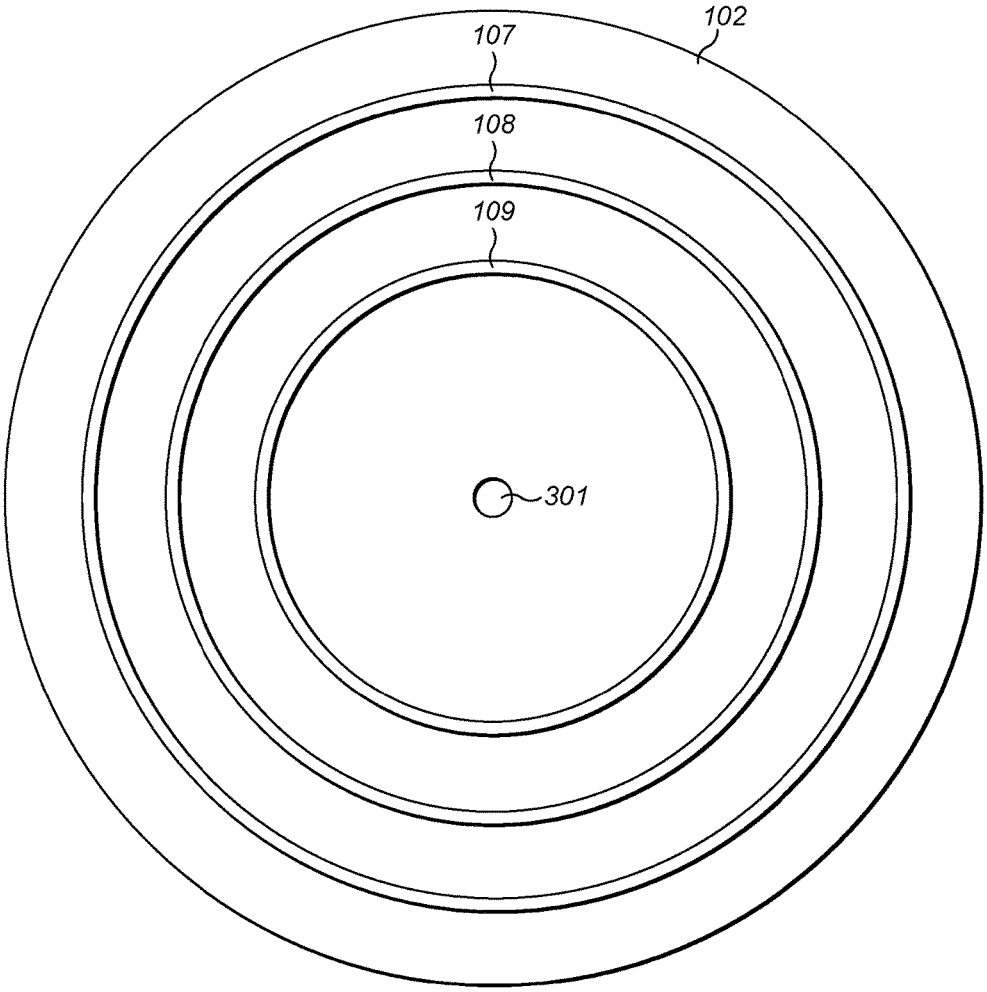
FIG. 3 shows a cross sectional view of the second frame of the loom.

The second frame 102 further comprise of one or more than one rings such as two rings or three rings. The rings can be of different diameter and thus are also the graded rings. As shown in FIG. 3, the three rings present on the second frame 102 are an outer ring 107, a middle ring 108 and an inside ring 109. The outer ring maybe of a diameter of 80-100 cm, the middle ring may be of 60-80 cm and the inner ring may be of 40-60 cm. The second frame also comprise of a center hole 301 wherein the column 110 can pass through the second column through the hole. The diameter of the second frame may range from 40-140 cm such as 60 cm or 120 cm. However, it can vary as per a user request of manufacturer. The frame may be a wooden frame or any other material as available and generally used.

Figure 2:
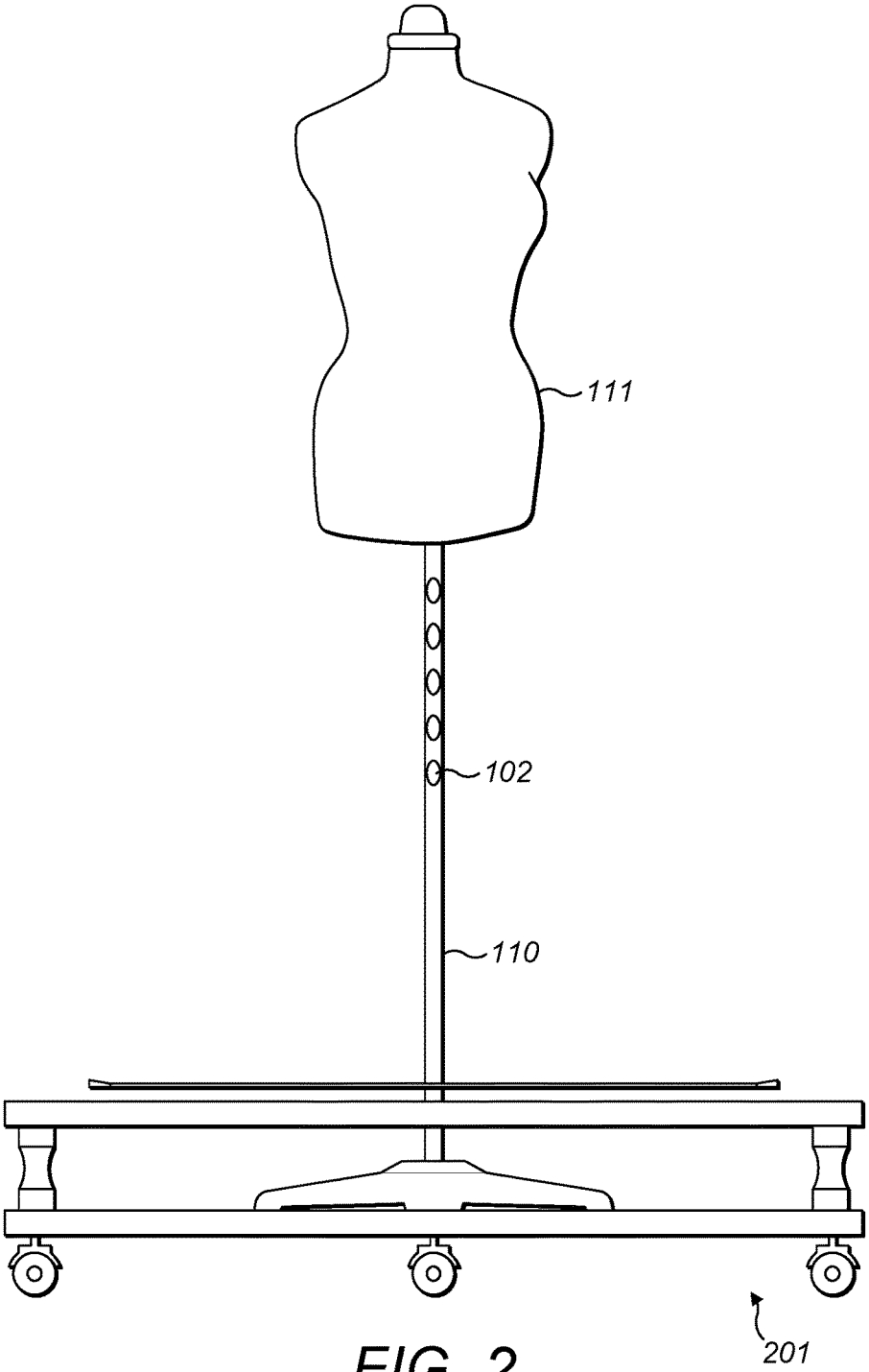
FIG. 2 shows a longitudinal view of the loom with the mannequin.

FIG. 2 shows a longitudinal section view 201 of the disclosed loom with the mannequin. As can be seen, the loom has a column 110 running through the center of the first frame and the second frame with a series of slider holes 202. The slider holes helps in adjusting a position of the mannequin. The mannequin comprise of a hook and the hook can fix or fit into the slider hole such as to fix the mannequin at a particular position as required by the user. There can be fixed number of slider holes in the middle or other position of the column or can be a series of slider hole running throughout the length of the column.

Figure 4:
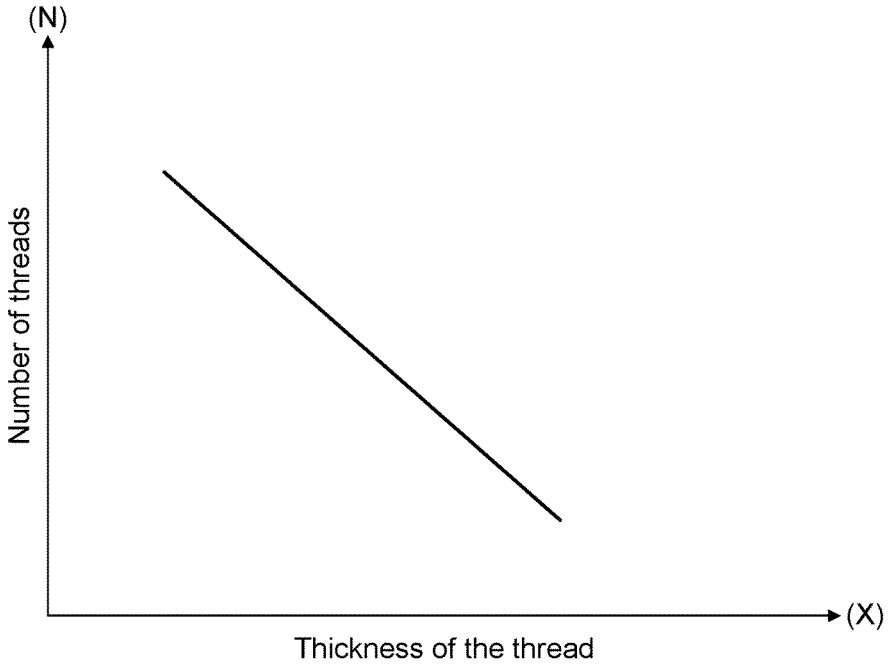
FIG. 4 shows a graph depicting a relationship between the number and thickness of the thread in a unit size such as a centimeter.

FIG. 4 shows a graph depicting a relationship between the number and thickness of a thread as used in production of a hand-made single piece of cloth or cloth product, wherein the thickness of the thread is inversely proportional to the number of threads in centimeter units.

Figure 5:
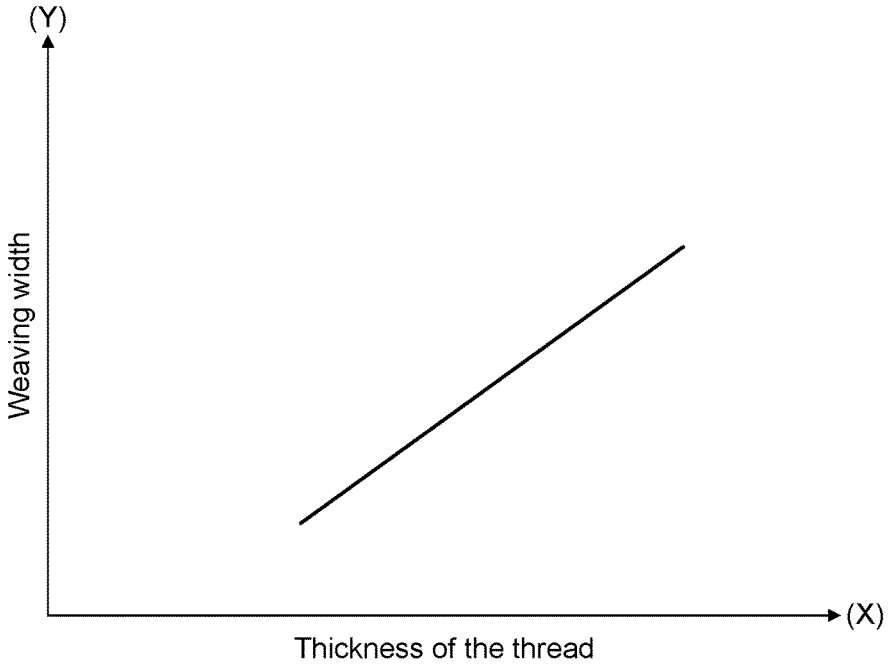
FIG. 5 shows a graph depicting a relationship between the thickness of the thread with the display output.

FIG. 5 shows a graph depicting a relationship between the thickness of the thread with the display output of the texture depending on the style to be achieved such that the thickness of the thread is directly proportional to the cross section resulting from the weaving process.

Figure 6:
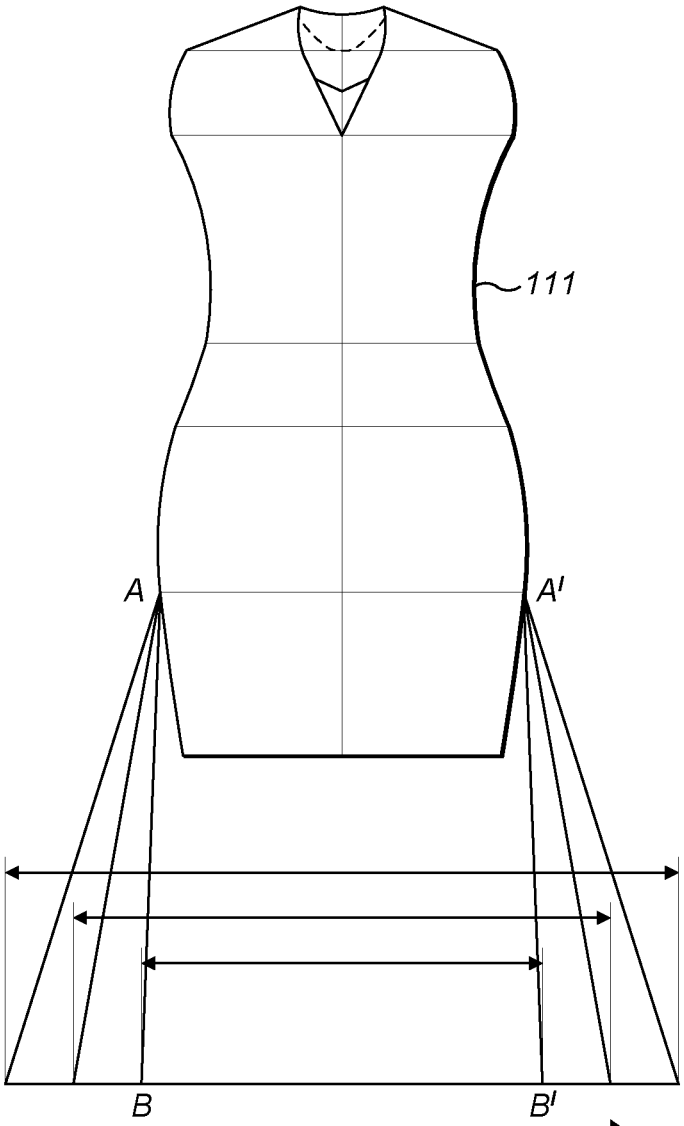
FIG. 6 shows a longitudinal section view of the manner with the disclosed loom.

FIG. 6 shows a longitudinal section of the cylindrical shape (AA' BB') of the cloth product as achieved 601 such that the cloth is weaved by letting the thread go down onto the graded rings present on the second frame.

Figure 7A:
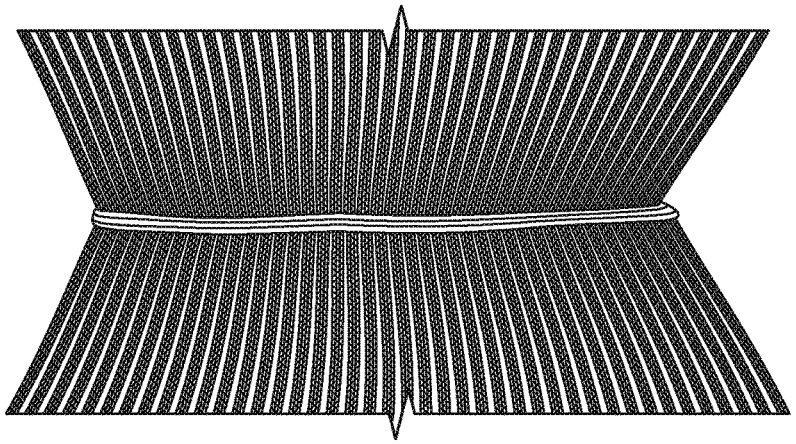
FIG. 7A-C shows a process of letting down a thread and weaving to form a single hand-made piece of cloth.
Figure 7B:
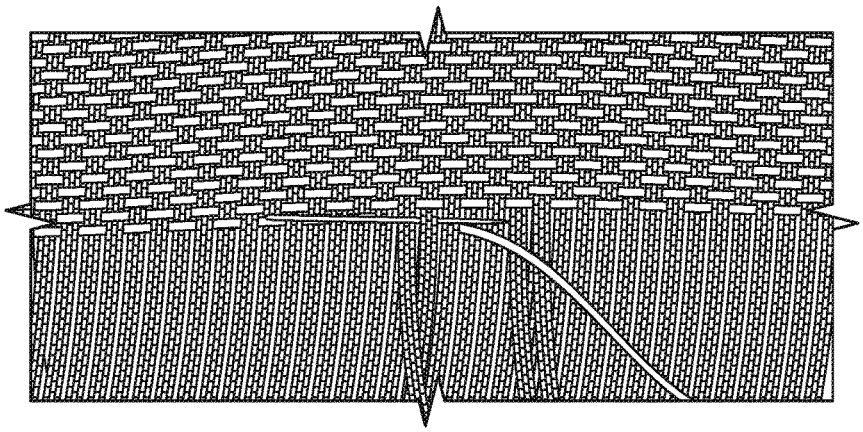
Figure 7C:
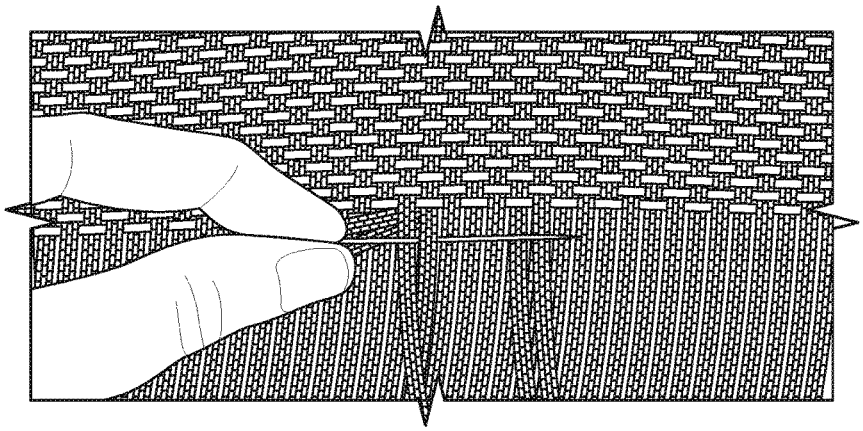

FIGS. 7A-C shows a process of letting down the thread from the mannequin up to the second frame specifically onto the ground rings and weaving the thread to form a piece of cloth up till the length required.

Figure 8:
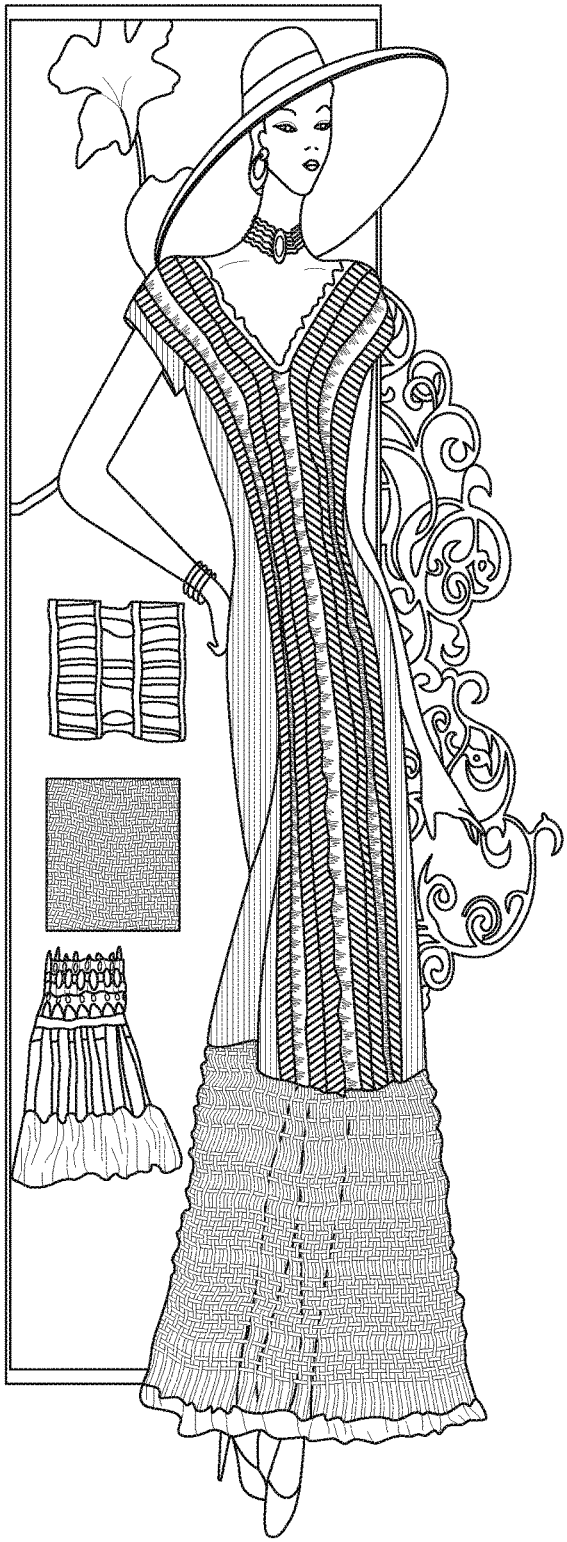
FIG. 8 shows a finished one piece cloth product following the used of disclosed loom.

FIG. 8 shows a finished product 801 resulting from weaving of the thread in all different and unique styles by letting the threads go down from the mannequin to the graded rings and weaving the threads in a unique fashion as to achieve a fashionable and unique product. The cloth can be prepared in different shapes, sizes, color, themes, patterns and so on.

The piece as produced will be all hand-made and be of exact size as required. The loom along with the mannequin helps in achieving a three dimensional piece of cloth with a designer creativity. It also helps in achieving clothes of different sizes and shapes ranging from a cylindrical shape or a conical shape. The mannequin can be adjusted through the use of slider column. The loom and mannequin can be easily transported from one location to another through the use of the wheels.

It adjusted according to the size of piece of cloth to be performed. Preparing the artificial body (mannequin) by inserting the Twine thread on the mannequin to determine the shape of the front cut out of the front and back as well as the waist and the tail lines. Letting down the mannequin from the line underneath with a consideration of the number of threads (n) in the Cm range between 5:15 thread Depending on the thickness of thread, the thickness of the thread inversely proportional with the number of threads in cm unit, FIG. (1) Diagram showing the relationship between the number and thickness of the thread.

Number of threads/cm n (N\cm(4-5—The thickness of the thread Q X) line the perimeter AA' to be letting down 94 cm, Tiger cotton thread 50/4, Number of threads in the 10 cm thread $$\text{Number of letting down threads} = n \times \text{Ocean} = 10 \times 94 = 940 \text{ thread}$$

And pull the letting down thread on the perimeter of the largest size

6—the scope of the interior metal ring mounted on the bottom base 2=BB' R $$R = 2 \times 3.14 \times 15 \approx 94 \text{ sm}$$

$$\text{Circumference of circle} = 2\pi r = 2 \times 3.14 \times r$$

7—the rate of the thread density thread on the perimeter of the largest size A A'/6.

the scope of the interior metal ring mounted on the bottom base B B'=940/94=10 thread/cm.

8—the threads inserting on the letting down perimeter of the largest size (buttocks scope) between the scope of the interior metal ring so, the cylindrical shape achieved.

1-9—Different methods are using in the weaving process in the sector AA'BB, the thickness of the cloth product appropriated according to the methods used in the implement, the thickness of the thread directly proportional With the cross resulting from weaving process, (2) Diagram showing the relationship between the thickness of the thread with the different cross resulting from the non-woven cloth with the different weaving style.

10—letting down process is repeated for each sector of the piece of cloth.

Although the present embodiments have been described with reference to specific example embodiments, it will be evident that various modifications and changes may be made to these embodiments without departing from the broader spirit and scope of the various embodiments. Accordingly, the specification and drawings are to be regarded in an illustrative rather than a restrictive sense.

What is claimed is:

1. A loom and a mannequin for weaving a hand-made single piece cloth, comprising:

a first frame; wherein the first frame comprises of a wheel such that a wheel helps in moving the loom from one location to another;

a second frame comprises of several rings to accommodate a shape of a front cut out of a front and back as well as a waist and a tail line for a production of the cloth; wherein the first frame and the second frame enables a twine thread to be inserted on the mannequin to produce the hand-made single piece cloth; and a column to hold the mannequin in place during a weaving process; wherein the mannequin represents an artificial body of a particular measurement and shape.

2. The loom as in claim 1, wherein the second frame comprise of more than one ring on the surface of the second frame.

3. The loom as in claim 1, wherein the second frame consists of three rings.

4. The loom of claim 1, wherein the first frame and second frame is connected through a leg.

5. The loom of claim 1, wherein the mannequin in placed onto the column of the loom.

6. The loom of claim 1, wherein the column further comprises of a slider hole.

7. The loom of claim 5 or 6, wherein the mannequin is fixed at a position through the slider hole.

8. A method of using a loom, comprising:

preparing an artificial body, such as a mannequin of a particular measurement and shape;

inserting a twine thread on the mannequin such that it helps in determining a shape of a front cut out of the front and back as well as a waist and a tail line for a production of a cloth;

letting the mannequin down from the line underneath with a consideration of a number of threads in the centimeter range;

letting the thread down from the mannequin following determination of the shape of the cut out from front and back of the mannequin along with the waist and tail line;

pulling the thread onto the perimeter of a largest size to a smallest ring present on a frame of the loom such that a network of thread is achieved according to a shape of the frame;

pulling the thread from all the sides of the mannequin onto the frame to form a complete piece of a cloth such that the cloth has a shape and size of according to the mannequin.

9. The method of claim 8, wherein the loom is used produce a hand-made single piece of cloth.

10. The method of claim 8, wherein the largest ring and the smallest ring is present onto a second frame of the loom.

11. The method of claim 8, wherein the frame is of a circular shape.

12. The method of claim 8, wherein the loom further comprise of a first frame.

13. The method of claim 8, wherein the loom produces a cylindrical shape cloth.

14. The method of claim 8, wherein the loom produces a conical shape cloth.

* * * * *